US005125695A

United States Patent [19]

Hartwell

[11] Patent Number: 5,125,695

[45] Date of Patent: Jun. 30, 1992

[54] SAFETY LATCH

[76] Inventor: Max H. Hartwell, 13144 Iroquois, Apple Valley, Calif. 92308

[21] Appl. No.: 770,186

[22] Filed: Oct. 2, 1991

[51] Int. Cl.[5] ..... E05C 5/02

[52] U.S. Cl. ..... 292/62

[58] Field of Search ..... 292/62, 60, 57, 69, 292/59, 61

[56] References Cited

U.S. PATENT DOCUMENTS

| | | | |
|---|---|---|---|
| Re. 11,606 | 6/1897 | Adams . | |
| 124,442 | 3/1872 | Kinkade . | |
| 475,922 | 5/1892 | Bernstein . | |
| 504,262 | 8/1893 | Adams . | |
| 760,528 | 5/1904 | Davies | 242/60 |
| 1,228,996 | 6/1917 | Walters | 292/57 |
| 1,580,611 | 4/1926 | Kirkpatrick | 292/60 X |
| 1,770,751 | 7/1930 | Hall | 292/57 |
| 4,066,284 | 1/1978 | Ikemura | 292/62 |

*Primary Examiner*—Richard E. Moore

*Attorney, Agent, or Firm*—Christie, Parker & Hale

[57] ABSTRACT

A safety latch with a backing member, a latch bolt and a housing for the latch bolt supported by the backing member. A spring is provided to bias the latch bolt in the open or unlocked position.

8 Claims, 1 Drawing Sheet

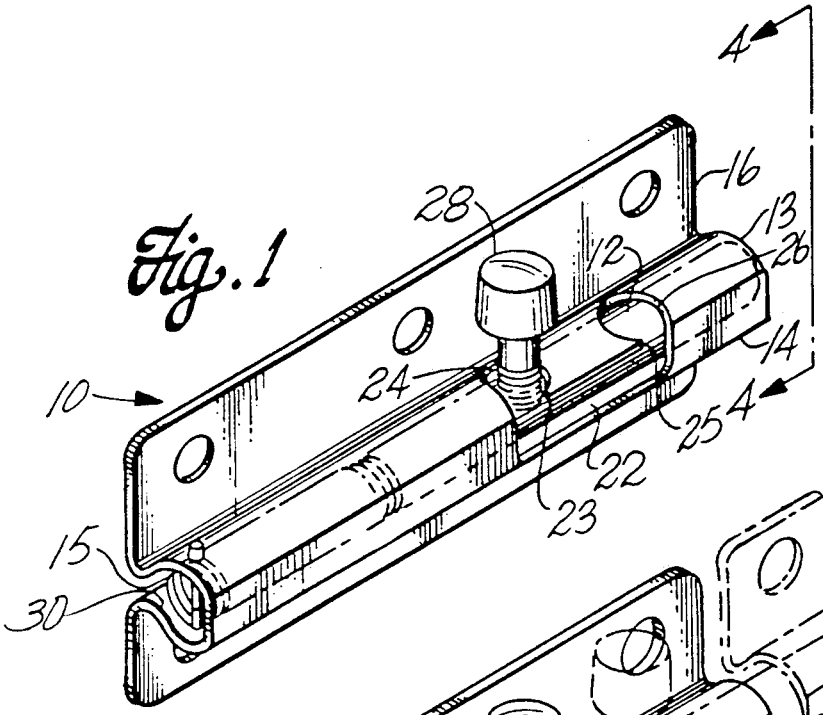
Fig. 1
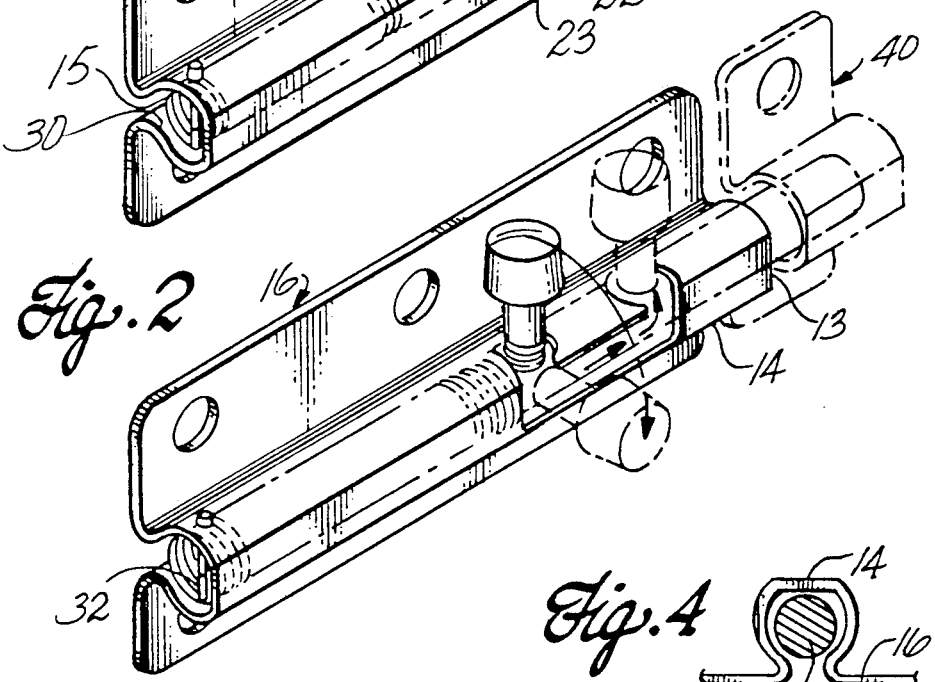
Fig. 2
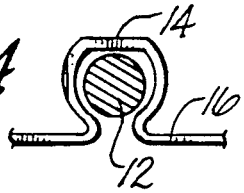
Fig. 4
Fig. 3
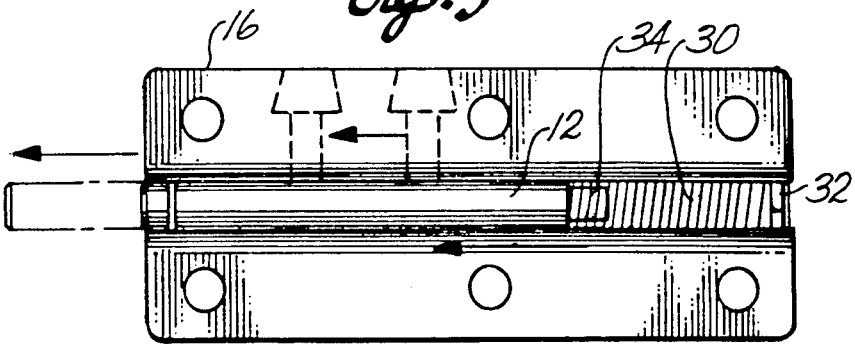

SAFETY LATCH

BACKGROUND OF THE INVENTION

The present invention relates to a safety latch and, more particularly, to a safety latch utilizing a movable latch bolt which is biased in the open or unlocked position to preclude accidental movement of the latch bolt into the locked position.

Bolt latches (sometimes called barrel bolts or slide bolts) have been well known for many years. Such devices are frequently used to lock or bolt doors, windows, containers, cabinets, etc. The latch bolt has been favored for many such applications because of its simplicity and ease of installation. Typically, such latches are used in situations where key locks are not necessary such as at the interior side of a door. Thus, for example, where a latch bolt is used in the interior, it is actuated after entrance as additional security against unwanted entry by others.

Latch bolts of the type heretofore known generally included a bolt slidable through a housing and extendible into a bolt keeper located and secured to the threshold, door jam or wall adjacent to the door. One difficulty encountered by such latch bolts is that the bolt may be accidentally moved into the locking position by vibration which may occur, for example, upon closure of the door, with the unfortunate result of causing the door to be inadvertently locked in the closed position leaving a person without access to the interior.

Various constructions and designs have been proposed for latch bolts of the type just described including some which have utilized springs. However, such devices have frequently involved excessively complicated construction and/or numerous parts which cause such devices to be difficult or expensive to manufacture or use. For example, where springs are positioned around the bolt fouling of the latch can occur if sand, dirt or other debris enters the mechanism and plugs the latch. Latches with weighted bolts have also been suggested but such latches are not able to be used in all positions. As a result these and other disadvantages, such latches are not commonly available in the marketplace.

The present invention provides a simple and efficient safety latch of the latch bolt type which avoids the above-described disadvantages and which is simple, efficient, economical to manufacture and can be installed in any position, e.g., vertical, horizontal, etc.

SUMMARY OF THE INVENTION

The present invention provides a safety latch which comprises a latch bolt, a housing for the latch bolt and a backing member to support the housing. The housing and backing member can be integrally formed as a unitary structure from a single piece of metal, such as by stamping. The latch may be fastened to a door or other structure, as desired, by any suitable means such as by providing holes in the backing member through which the latch may be fastened with screws to a door or other structure with which the safety latch is intended to be used.

The housing is formed with a passageway therethrough having an open end. The "open end" referred to herein is intended to indicate the end of the latch through which the latch bolt is extendible to enable the bolt to engage a keeper or other latch bolt engaging means in order to place the latch in the locked position. The housing is also provided with an elongated opening that terminates in detents at opposite ends of the opening. A detent engaging means is fixed to the latch bolt and extends through the elongated opening in the housing. Thus, the latch bolt may be moved a distance approximately equal to the length of the elongated opening by moving the detent engaging means from one end of the elongated opening to the other.

Spring means are provided to connect the housing to the latch bolt. One end of the spring means is fixed to the housing and the other end is fixed to the latch bolt at the end of the bolt furthest from the open end of the housing. The spring is substantially coaxial with the latch bolt and, advantageously, of about the same outside diameter. In assembling and fixing the spring means to the latch bolt within the housing, the latch bolt is secured to the spring in such a way that the spring causes a torsional force to be applied to the latch bolt to cause the detent engaging means, also fixed to the latch bolt as aforesaid, to be biased against the backing member when seated in either detent. This may be accomplished, for example, by first rotating the latch bolt while holding the opposite end of the spring fixed to cause the spring to be in torsion prior to installation in the housing passageway so that the detent engaging means is biased against the backing member when positioned in either detent. Alternatively, the spring and latch bolt can be joined and positioned in the housing so the torsional force of spring means, e.g., the helical spring, at rest is sufficient to bias the bolt and detent engaging means, as described, without further need to rotate the spring.

The latch bolt is extendible through the open end of the housing into the latch locking position by moving the detent engaging means to the detent closest to the open end of the housing. Such movement of the detent engaging means and latch bolt places the spring means in tension. Therefore, the latch bolt cannot be accidentally moved into the latch bolt keeper to lock the latch by vibration or other force inadvertently applied to the latch bolt because the compressive force of the spring will keep the latch bolt in the unlocked position unless the detent engaging means is deliberately placed in the detent that maintains the bolt in the locked position. If the detent engaging means is intentionally or accidentally disengaged from the latch locking position, the compressive and torsional forces of the spring means will cause the detent engaging means to come to rest in the detent furthest away from the open end of the housing, thereby maintaining the latch bolt safely disengaged.

BRIEF DESCRIPTION OF THE DRAWINGS

FIG. 1 is a perspective view of the safety latch in accordance with the invention;

FIG. 2 is a perspective view of the safety latch shown in FIG. 1 but also showing in phantom the latch bolt in the locked position;

FIG. 3 is a rear view of the safety latch shown in FIG. 1; and

FIG. 4 is a side view of the safety latch shown in FIG. 1.

DESCRIPTION OF THE PREFERRED EMBODIMENT

Referring to FIGS. 1–4 of the drawings wherein like numerals refer to like parts, there is seen the safety latch 10 of the invention. The safety latch comprises a latch bolt 12, a housing 14 and a backing member 16. As illustrated, the backing member and housing may be integrally formed as a unitary structure into any suitable configuration, such as that shown in the drawings. Alternatively, the backing member and housing may be separate components joined together. The housing is formed with an internal passageway 15, terminating in open end 13, perhaps best seen in FIG. 3 but which is evident also in FIGS. 1 and 2. The latch bolt 12 is longitudinally moveable within the passageway 15 between locking and unlocking positions. The housing 14 is formed with an elongated opening 22 which terminates in detents 24 and 26 at opposite ends of the opening. Detent engaging means 28 is fixed to the latch bolt 12 and extends through the elongated opening 22 in the housing. Thus, the latch bolt is movable within the housing passageway 15 a distance defined by the length of the elongated opening 22.

Spring means 30, advantageously in the form of a helical spring as shown, is fixed at one end to the housing, such as by means 32, and to its other end to the latch bolt, such as by being threaded onto threads in the latch bolt as shown at 34. It is obvious that other means of fastening the spring 30 to the housing and latch bolt may be employed than the specific means described herein and illustrated in the drawings. In the embodiment illustrated, the housing is configured so as to retain the latch bolt and spring within the housing passageway.

In assembling the safety latch in this embodiment, the latch bolt is first rotated after being fixed to the spring and with the opposite end of the spring held by or fixed to the housing so as to create a torsional force in the spring that biases the detent engaging means 28 against the backing member. This may be done by rotating the latch bolt with the spring threaded thereto prior to installing the latch bolt into the housing. The torsional force thus created assists in maintaining the detent engaging means in the detents 24 and 26 when placed in those positions. As shown, the locking detent 26 may also advantageously be configured with projection 25, like a crescent, to assist in retaining the detent engaging means in the locked position within it by surrounding no less than half of the detent engaging means when it is positioned therein. Although detent 24 may be similarly configured, as shown, it is not necessary.

In summary, one method of assembling the latch is to thread the spring into the bolt, slide the bolt and spring into the passageway of the housing, attach the spring to the housing, rotate the bolt to achieve the desired torsion in the spring to hold the detent engaging means against the backing member when installed into the bolt, and then installing the detent engaging means by threading or press fitting into an opening provided in the bolt to receive it.

As seen in FIG. 1 the safety latch is in the unlocked position. To lock the safety latch or place it in the locking position, the detent engaging mean is rotated downward as shown by the arrow into the position shown in phantom and then moved in the direction of the longitudinal arrow within the elongated opening and into detent 26, i.e., into the position shown in phantom. When in this position, the latch bolt 12 extends through the open end 13 of the housing 14 into a latch bolt receiving means, or keeper, 40, shown in phantom adjacent the safety latch. The latch bolt is aided in being kept in the locked position by projection 25 provided at the detent 26 and the torsional and compressive force of the spring which cause the detent engaging means to rest against the backing member 16 while being restrained in detent 26.

It is obvious from the foregoing, that the safety latch in accordance with the invention cannot be accidentally and inadvertently moved into the locking position due to the combination of the torsional force applied to the detent engaging means which biases the detent engaging means against the backing member and the compressive force of the spring which biased the latch bolt into the open or unlocked position. It should also be apparent that various changes and modifications may be made without departing from the scope of the invention. For example, the configuration of the latch components including the housing, detent engaging means and elongated passageway may be varied along with the configuration of the detents themselves. The means described for fixing the spring to the housing and to the latch bolt may also be varied so long as the function described is attained. The backing member may be conveniently provided with holes, as shown, to permit fastening of the latch to a door or other structure by means of screws or other fasteners. Accordingly, the scope of the invention should be limited only by the appended claims, wherein what is claimed is:

I claim:

1. A safety latch comprising a latch bolt, a housing for said latch bolt and a backing member supporting said housing, said housing having a longitudinal passageway with an open end and an elongated opening terminating in detents at opposite ends of the elongated opening, said detent closest to said open end of said passageway in said housing being configured like a crescent, said latch bolt being moveable longitudinally within said passageway and extendible through said open end;

spring means substantially coaxial with the latch bolt and extending longitudinally from the latch bolt at the end of the latch bolt opposite said open end of the housing, said spring means being fixed at one end to the end of the latch bolt from which it extends and at the other end to the housing;

detent engaging means fixed to the latch bolt and extending through the elongated opening in said housing;

said spring means biasing said detent engaging means against the backing member when positioned in either detent;

said latch bolt being extendible through the open end of the housing into a latch locking position by moving said detent engaging means to the detent closest to said open end of the housing, said movement of the detent engaging means and latch bolt stretching said spring means and placing said spring means in tension whereby said latch bolt cannot be accidentally moved to the locking position and if said detent engaging means is accidentally disengaged from the latch locking position, the tensive and biasing forces of said spring means causes said detent engaging means to come to rest in the detent furthest away from said open end against the backing member, thus maintaining the latch bolt safely disengaged.

2. A safety latch according to claim 1 wherein said detent retaining the latch bolt in the locked position is configured like a crescent to surround no less than half of the circumference of the detent engaging means when the latter is positioned therein.

3. A safety latch according to claim 1 wherein said backing member and housing comprise a unitary structure.

4. A safety latch according to claim 1 wherein said latch bolt is of substantially circular cross section and said passageway in said housing is at least partially of circular configuration, the passageway being sized to permit the latch bolt and spring means fixed to the latch bolt to smoothly and freely move longitudinally therein.

5. A safety latch according to claim 1 further comprising means to maintain said latch bolt and spring means in said passageway.

6. A safety latch according to claim 1 wherein the latch bolt end to which the spring means is fixed is threaded and the spring means is a helical spring and is fixed to the latch bolt by threading the helical spring on the threads of the latch bolt and the biasing force to bias said detent engaging means against said backing member is created by said spring being rotated with one end fixed to create a torsional force therein.

7. A safety latch according to claim 1 wherein said latch bolt and spring means are of substantially the same outside diameter so that the passageway may be configured with minimum clearance to accommodate movement of the latch bolt and spring means therein.

8. A safety latch comprising a latch bolt, a housing for said latch bolt and a backing member supporting said housing, said housing having a longitudinal passageway with an open end and an elongated opening terminating in detents at opposite ends of the elongated opening, said latch bolt having one threaded end and being moveable longitudinally within said passageway and extendible through said open end;

helical spring means substantially coaxial with the latch bolt and extending longitudinally from the latch bolt at the end of the latch bolt opposite said open end of the housing, said spring means being threaded at one end to the threaded end of the latch bolt and fixed at the other end to the housing;

detent engaging means fixed to the latch bolt and extending through the elongated opening in said housing;

said spring means biasing said detent engaging means against the backing member when positioned in either detent by being rotated with one end fixed to create a torsional force therein;

said latch bolt being extendible through the open end of the housing into a latch locking position by moving said detent engaging means to the detent closest to said open end of the housing, said movement of the detent engaging means and latch bolt stretching said spring means and placing said spring means in tension whereby said latch bolt cannot be accidentally moved to the locking position and if said detent engaging means is accidentally disengaged from the latch locking position, the tensive and biasing forces of said spring means causes said detent engaging means to come to rest in the detent furthest away from said open end against the backing member, thus maintaining the latch bolt safely disengaged.

* * * * *